United States Patent [19]

Ball et al.

[11] Patent Number: 4,999,846

[45] Date of Patent: Mar. 19, 1991

[54] STRAP AND BUCKLE ASSEMBLY

[75] Inventors: Roger M. Ball, Toronto; Steve A. Copeland, Pickering, both of Canada

[73] Assignee: Safeco Mfg. Limited, Scarborough, Canada

[21] Appl. No.: 491,456

[22] Filed: Mar. 9, 1990

[51] Int. Cl.[5] ..... A42B 3/04; A44B 11/06

[52] U.S. Cl. ..... 2/5; 2/417; 2/418; 24/170; 24/191; 24/68 E

[58] Field of Search ..... 2/5, 417, 418, 420, 2/183; 36/117, 50; 24/170, 68 SK, 68 E, 70 SK, 71 SK, 191

[56] References Cited

U.S. PATENT DOCUMENTS

| | | | |
|---|---|---|---|
| 2,327,741 | 8/1943 | Poole | 24/170 |
| 3,221,340 | 12/1965 | Joffe | 2/417 |
| 3,992,720 | 11/1976 | Nicolinas | 2/418 |
| 4,304,055 | 12/1981 | Hanson | 36/50 |
| 4,433,458 | 2/1984 | Olivieri | 24/191 |
| 4,683,620 | 8/1987 | Valsecchi et al. | 24/71 SK |

FOREIGN PATENT DOCUMENTS

| | | | |
|---|---|---|---|
| 224288 | 6/1987 | European Pat. Off. | 24/68 SK |
| 2806422 | 8/1978 | Fed. Rep. of Germany | 24/68 SK |
| 595070 | 1/1978 | Switzerland | 24/68 SK |

*Primary Examiner*—Werner H. Schroeder
*Assistant Examiner*—Michael A. Neas
*Attorney, Agent, or Firm*—Fetherstonhaugh & Co.

[57] ABSTRACT

A strap and buckle assembly wherein a plurality of ratchet teeth are formed on the strap and the buckle has a ratchet type of catch for releasably retaining the strap. The housing of the buckle has a slipway which receives the strap. A catch lever is pivotally mounted on the housing for movement between a locking position and a release position. The catch lever having first and second portions of its length extending from opposite sides of its pivotal axis. A shoulder is formed on the first portion of the catch lever and is arranged to be oppositely disposed with respect to the locking faces of the ratchet teeth when the catch lever is in the locking position. Resiliently deformable catch biasing arms are formed integrally with and extending from the second portion of the catch lever into contact with the housing. The arms normally urging the catch lever toward the locking position and are deformable in response to movement of the catch lever toward the release position to an extend sufficient to withdraw said shoulder from engagement with said locking faces of the ratchet teeth.

7 Claims, 2 Drawing Sheets

STRAP AND BUCKLE ASSEMBLY

BACKGROUND OF INVENTION

This invention relates to a strap and buckle assembly. In particular, this invention relates to a strap and buckle assembly which is suitable for use in the fireman's helmet to effect adjustment of the nape portion of the head harness.

Strap and buckle assemblies that permit tightening of the straps through the buckle or preventing release of the strap are well known. Difficulty has, however, been experienced in providing simple, inexpensive and efficient buckles that can be easily displaced to the position required to release the strap while also affording a sufficiently strong connection with the strap to prevent undesired release of the strap.

A factor in the cost of reducing and assembling a buckle is the number of components required in order to assemble the buckle.

In the head-supporting harness of a fireman's helmet or the like, it is known to provide a floating nape band. The floating nape band has one end securely fastened with respect to the harness and its other end is slidably adjustable with respect to the headband so that the effective length of the headband can be adjusted to accommodate different head sizes.

It is also known to provide an adjustment strap that also has one end anchored with respect to the headband and its other end releasably secured in a buckle member. With the known type of buckle member, it is difficult to effect adjustment of the position of the adjustment strap without removing the helmet from the head of the wearer. It is necessary to remove the helmet and to open the catch member and then make the required length adjustment and then to close the catch member to clamp the strap therebetween.

When a fireman's helmet is being worn as a standard piece of uniform equipment, it is necessary to have the headstrap tightly drawn about the head of the wearer. It is difficult to achieve this type of fit when the length of the head band must be preset before the helmet is placed on the head of the wearer. It is, therefore, advantageous to provide a size adjustment mechanism which can be quickly and easily adjusted by the fireman after the helmet is placed on the fireman's head.

SUMMARY OF INVENTION

It is an object of the present invention to provide a simple and inexpensive adjustment strap and buckle assembly which will permit the user to adjust the effective length of the strap with ease in use.

It is a further object of the present invention to provide a quick release, quick lock buckle and adjustment strap for the head harness of a fireman's helmet.

According to one aspect of the present invention there is provided in a strap and buckle assembly the improvement of; a plurality of ratchet teeth formed on the strap, the ratchet teeth each having a locking face directed toward a first end of the strap, and said buckle comprising; a housing having a front end and a back end and a slipway extending through the housing from the front end to the back end, a catch lever pivotally mounted on the housing for movement between a locking position and a release position about an axis that extends transversely of the slipway, the catch lever having first and second portions of its length extending from opposite sides of said axis toward the front and back ends of the housing respectively, a shoulder on said first portion arranged to be oppositely disposed with respect to the locking faces of the ratchet teeth when the catch lever is in the locking position, resiliently deformable catch biasing arms formed integrally with and extending from the second portion of the catch lever, one on either side of the slipway, into contact with the housing, said arms being resiliently deformed by contact with the housing and normally urging the catch lever toward the locking position and being further resiliently deformable in response to movement of the catch lever toward the release position to an extent sufficient to withdraw said shoulder from engagement with said locking faces of the ratchet teeth.

BRIEF DESCRIPTION OF THE DRAWINGS

The invention will be more clearly understood after reference to the following detailed specification read in conjunction with the drawings wherein.

DESCRIPTION OF PREFERRED EMBODIMENT

Figure 1:
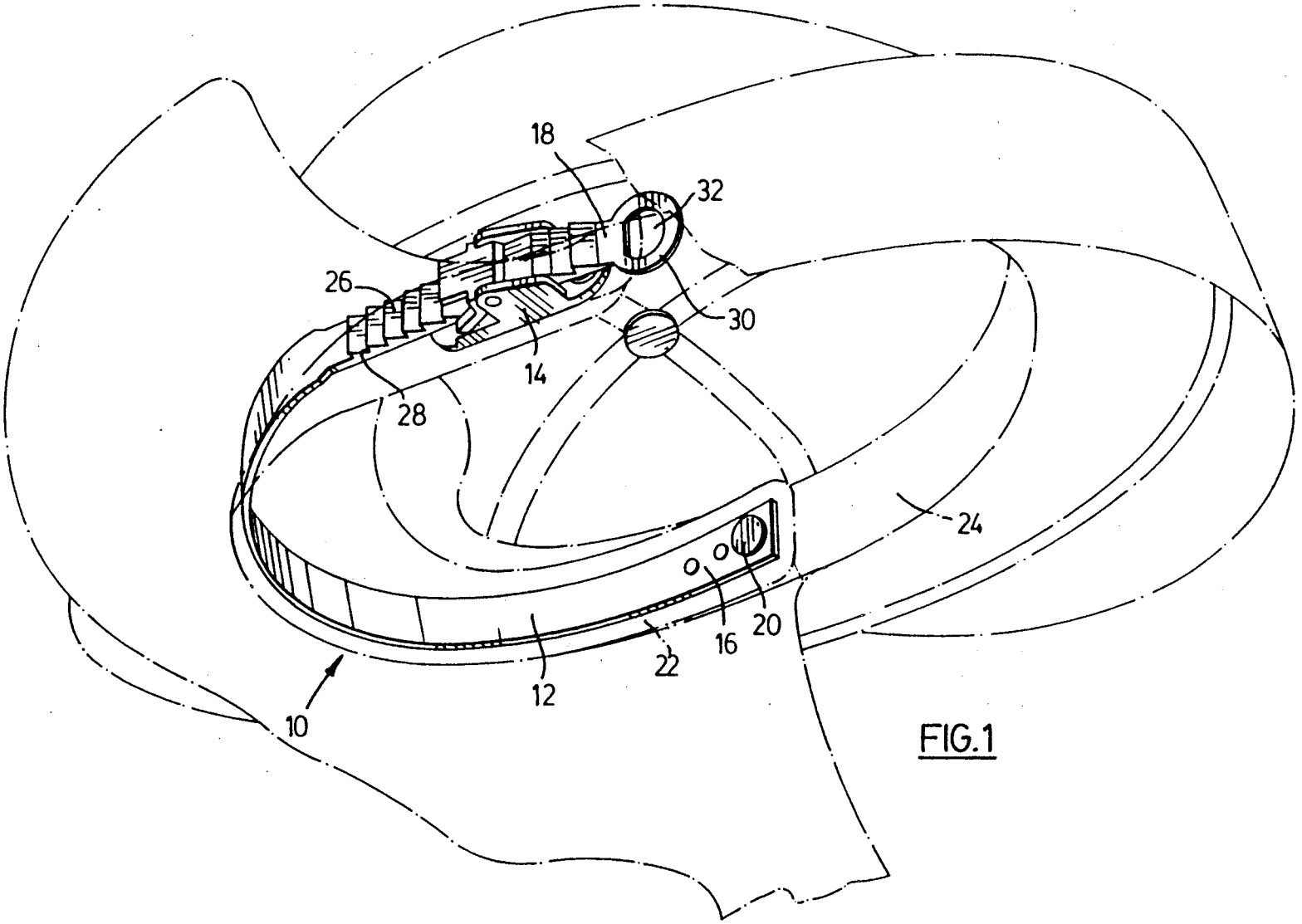
FIG. 1 is a pictorial view of the underside of an adjustment strap and retainer member illustrated in the manner in which it is mounted on the harness of a fireman's helmet.
Figures 2, 3:
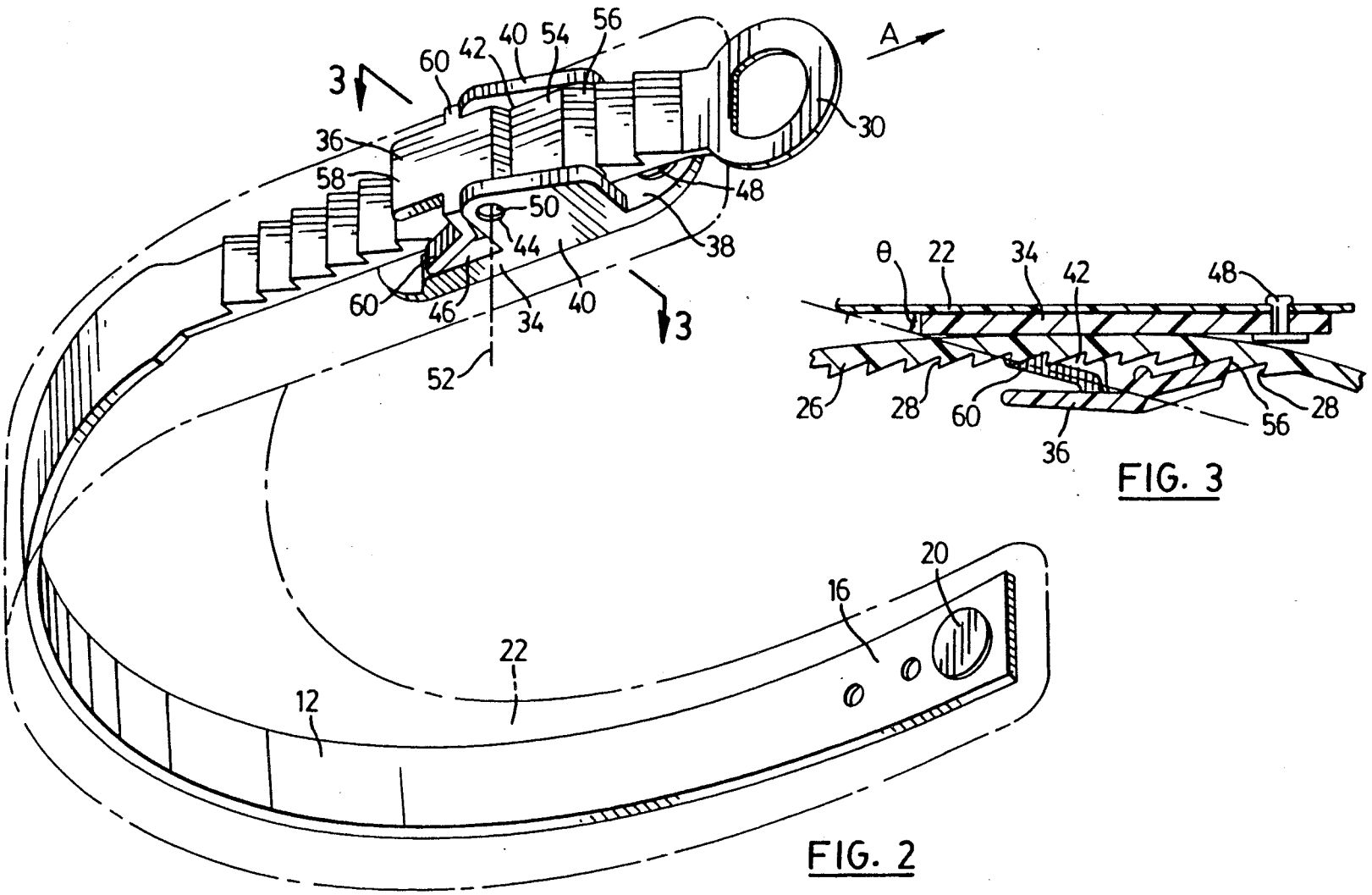
FIG. 2 is an enlarged pictorial view similar to FIG. 1.
FIG. 3 is a sectional view taken along the line 3 of FIG. 2.

With reference to FIG. 1 in the drawings, the reference numeral 10 refers generally to an adjustment strap and buckle assembly constructed in accordance with an embodiment of the present invention. The assembly 10 comprises an adjustment strap 12 and a buckle 14. The adjustment strap 12 has a back end 16 and a front end 18. The strap 12 is made from a flexible material, preferably a non-flammable plastics material. Fasteners 20 serve to retain the back end 16 of the strap 12 with respect to one end of the nape section 22 of the headband 24. The strap 12 also has a plurality of ratchet teeth 26 formed thereon adjacent to the front end thereof, each of the teeth 26 has a locking face 28 that is directed toward the back end of the strap. A manually engagable ring 30 is formed at the front end of the strap 18. The ring 30 has a finger opening 32 formed therein which will permit the fireman to grasp the front end of the strap to pull it through the buckle 14. The buckle 14 comprises a housing 34 and a catch lever 36. The housing 34 has a base portion 38 from which a pair of side walls 40 project upwardly, one on either side of the slipway channel 42. Each of the side walls 40 has a passageway 44 formed therein. A raised platform 46 is also provided at each side of the slipway 42 rearwardly from the side walls 40. The platforms 46 serve to define opposite sides of the slipway and extend the length of the slipway and thereby reduce the likelihood of disportion of the portion of the strap that is located in the buckle. A fastener 48 is provided which serves to secure the housing 34 to the free end of the nape strap 22. The housing 12 is made from a one-piece plastics molding. The catch lever 36, which is also a one-piece plastics molding, has a pair of stub shafts 50 projecting outwardly from opposite sides thereof into the passages 44 which serve to permit the catch lever to pivot about the axis 52 between a locking position and a release position. The axis 52 extends transversely of the slipway 42. The catch lever 36 has a first portion 54 that projects forwardly from the axis 52. The first portion 54 has a locking shoulder 56 at the outer end thereof that serves to bear against a locking face 28 of one of the ratchet teeth 26 as shown in FIG. 3 of the drawings prepared. The catch lever 36 also has a second portion 58 of its length that extends rearwardly from the axis 52. The second portion 58 forms a lever arm that can be depressed to move the first portion from the locking position shown in FIG. 3 to a release position in which the shoulder 56 is withdrawn from alignment with the locking faces 28 by causing the catch lever to pivot about the axis 52. Resiliently deformable catch biasing arms 60 extend downwardly from the second portion 58 of the catch lever and bear against the platforms 46 of the housing. The raised platforms 46 together with the short vertical portions of the arms 60 serve to permit the angle of inclination of the lower arm portion with respect to the plane of the slipway to be reduced to facilitate slippage along the platforms 40 during the release of the catch. The arms 60 are arranged to apply a moment to the catch lever about the axis 52 which normally urges the catch lever to the locking position shown in FIG. 3. The moment that is applied is sufficient to retain the catch lever in the locking position, but is not so great that it would prevent the deflection of the lever arm toward the raised position in response to a load applied in the direction of the arrow A to the manually engagable ring 30, with the result that the effective length of the strap can be reduced without the need to manually displace the catch lever. On the other hand, if the effective length of this strap has to be increased, it is necessary to manually engage the second portion of the catch lever to cause it to pivot about the axis 52 to raise the locking face 56 out of engagement with the locking shoulders 28 to permit the strap to slide freely in the slipway. As soon as the portion 36 of the catch lever is released, the energy stored in the arms 60 will serve to urge the catch lever to move toward the locking position to once again cause the locking face 56 to engage a locking shoulder 28.

It will be apparent that while the strap and buckle assembly of the present invention is particularly suitable for use in a harness of a fireman's helmet, it may also be used in any other field in which a strap and buckle assembly is required. The same mechanism could be used for assembling straps and buckles for a wide variety of applications and by describing a preferred embodiment it is not intended that the invention be limited to the preferred embodiment.

I claim:

1. In a strap and buckle assembly comprising (a) a plurality of ratchet teeth formed on the strap, the ratchet teeth each having a locking face directed toward a first end of the strap, and (b) said buckle comprising; slipway extending through the housing from the front end to the back end, (ii) a catch lever pivotally mounted on the housing for movement between a locking position and a release position about an axis extending transversely of the slipway, the catch lever having first and second portions of its length extending from opposite sides of said axis toward the front and back ends of the housing respectively, a shoulder on said first portion arranged to be oppositely disposed with respect to the locking faces of the ratchet teeth when the catch lever is in the locking position, resiliently deformable catch biasing arms formed integrally with and extending from the second portion of the catch lever, one on either side of the slipway, into contact with the housing, said arms being resiliently deformed by contact with the housing and normally urging the catch lever toward the locking position and being further resiliently deformable in response to movement of the catch lever toward the release position to an extent sufficient to withdraw said shoulder from engagement with said locking faces of the ratchet teeth.

2. A strap and buckle assembly as claimed in claim 1 wherein the catch biasing arms extend downwardly from and are rearwardly inclined with respect to the catch lever from a point on the second portion of the catch lever adjacent said axis.

3. A strap and buckle assembly as claimed in claim 1 wherein said housing, comprises a base portion and a pair of side walls extending upwardly from the base portion and from opposite sides of the slipway channel and serve to cooperate with the catch lever to retain the strap in the slipway.

4. A strap and buckle assembly as claimed in claim 3 wherein said housing further comprises a raised platform at each side of the slipway, each platform forming a portion of a side of the slipway extending rearwardly from each side wall, said raised platforms having an upper face underlying the catch biasing arms of the catch lever.

5. A fireman's helmet, of the type having a head harness including an adjustable nape section and an adjustment strap extending around the nape section and through a buckle, wherein the adjustable strap has a free end formed with a plurality of ratchet teeth having locking faces directed away from the free end, and wherein the buckle comprises;

(a) a housing having a front end and a back end and a slipway extending through the housing from the front end to the back end, (b) a catch lever pivotally mounted for movement between a locking position and a release position about an axis extending transversely of the slipway, said catch lever having first and second portions of its length extending from opposite sides of said axis toward the front and back ends of the housing respectively, a shoulder on said first portion arranged to be oppositely disposed with respect to the ratchet teeth when the catch lever is in the locking position, resiliently deformable catch biasing arms formed integrally with and extending from the second portion of the catch lever, one on either side of the slipway, into contact with the housing, said arms being resiliently deformable by contact with the housing to normally urge the catch lever toward the locking position and being further resiliently deformable in response to movement of the catch lever toward the release position to an extent sufficient to permit the shoulder to be displaced from engagement with the ratchet teeth.

6. A fireman's helmet as claimed in claim 5 wherein said housing comprises a base portion and a pair of side walls extending upwardly from the base portion and from opposite sides of the slipway channel and serve to cooperate with the catch lever to retain the strap in the slipway.

7. A fireman's helmet as claimed in claim 6 wherein said housing further comprises a raised platform at each side of the slipway, each platform forming a portion of a side of the slipway extending rearwardly from each side wall, said raised platforms having an upper face underlying the catch biasing arms of the catch lever.

* * * * *